US012054816B2

(12) United States Patent
Huang et al.

(10) Patent No.: US 12,054,816 B2
(45) **Date of Patent: *Aug. 6, 2024**

(54) AUTOMOTIVE STEEL AND A METHOD FOR THE FABRICATION OF THE SAME

(71) Applicant: THE UNIVERSITY OF HONG KONG, Hong Kong (CN)

(72) Inventors: Mingxin Huang, Hong Kong (CN); Binbin He, Hong Kong (CN)

(73) Assignee: THE UNIVERSITY OF HONG KONG, Hong Kong (CN)

( * ) Notice: Subject to any disclaimer, the term of this patent is extended or adjusted under 35 U.S.C. 154(b) by 83 days.

This patent is subject to a terminal disclaimer.

(21) Appl. No.: 16/959,282

(22) PCT Filed: Jan. 5, 2018

(86) PCT No.: PCT/CN2018/071470

§ 371 (c)(1),
(2) Date: Jun. 30, 2020

(87) PCT Pub. No.: WO2019/134102

PCT Pub. Date: Jul. 11, 2019

(65) Prior Publication Data

US 2021/0054476 A1 Feb. 25, 2021

(51) Int. Cl.

| | |
|---|---|
| ***C22C 38/04*** | (2006.01) |
| ***C21D 1/20*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |

(52) U.S. Cl.

CPC ..... *C22C 38/04* (2013.01); *C21D 1/20* (2013.01); *C21D 8/0205* (2013.01); *C21D 8/0226* (2013.01); *C21D 8/0236* (2013.01); *C21D 8/0263* (2013.01); *C21D 9/46* (2013.01); *C22C 38/002* (2013.01); *C22C 38/02* (2013.01); *C22C 38/06* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/001* (2013.01); *C21D 2211/008* (2013.01)

(58) Field of Classification Search

CPC ..... C22C 38/04

See application file for complete search history.

(56) References Cited

U.S. PATENT DOCUMENTS

| | | | | |
|---|---|---|---|---|
| 11,186,890 | B2 * | 11/2021 | Huang | C22C 38/06 |
| 2019/0211417 | A1 * | 7/2019 | Palzer | C22C 38/26 |
| 2020/0087764 | A1 * | 3/2020 | Sano | C22C 38/58 |

FOREIGN PATENT DOCUMENTS

| | | | | |
|---|---|---|---|---|
| CN | 102400036 | A | 4/2012 | |
| CN | 102943169 | A | 2/2013 | |
| CN | 103255340 | A | 8/2013 | |
| CN | 106498292 | A | 3/2017 | |
| EP | 0 499 298 | A1 | 8/1992 | |
| WO | WO-2012077150 | A2 * | 6/2012 | C21D 6/005 |
| WO | WO-2018105003 | A1 * | 6/2018 | C21D 9/46 |

OTHER PUBLICATIONS

English machine translation of CN 106498292 A of Zhu (Year: 2017).*

International Search Report and Written Opinion dated Sep. 7, 2018 in International Application No. PCT/CN2018/071470.

* cited by examiner

*Primary Examiner* — Jophy S. Koshy

(74) *Attorney, Agent, or Firm* — SALIWANCHIK, LLOYD & EISENSCHENK

(57) ABSTRACT

A strong and ductile automotive steel comprising 8-11 wt. % Mn, 0.1-0.35 wt. % C, 1-3 wt. % Al, 0.05-0.5 wt. % V, and a balance of Fe. By tuning the amount of austenite stabilizers, a dual phase microstructure of martensite and austenite with proper phase fraction can be achieved at room temperature. The martensite partitions C into the retained austenite grains. The martensite matrix can ensure the higher strength of automotive steel while the retained austenite grains with varied mechanical stability can improve the ductility of automotive steel, achieving the strength of 1500 MPa and the ductility of 20% simultaneously. The method for fabricating this automotive steel circumvents the high quenching temperature of conventional Q&P steels and therefore reduces the production price and is easy for mass production.

11 Claims, 3 Drawing Sheets

AUTOMOTIVE STEEL AND A METHOD FOR THE FABRICATION OF THE SAME

CROSS-REFERENCE TO RELATED APPLICATION

This application is the U.S. national stage application of International Patent Application No. PCT/CN2018/071470, filed Jan. 5, 2018, the disclosure of which is incorporated herein by reference in its entirety.

TECHNOLOGY FIELD

The present invention generally relates to a strong and ductile automotive steel, and a method for making this automotive steel.

BACKGROUND ART

The lightweight automobile is desirable for energy savings, less greenhouse emissions and being otherwise environment-friendly. Therefore, the lightweight automobile is an irreversible trend for the automotive industry worldwide. This point can be substantiated by the wide usage of advanced high strength steels (AHSS) in the automotive industry. AHSS are mainly applied in fabrication of structural components in automobiles such as B pillars. Owing to the high strength, the AHSS, including dual phase (DP) steel and quenching & partitioning (Q&P) steel, can use thinner plate as compared to conventional steels to achieve the lighter weight of automobiles without sacrificing passenger safety.

Currently, DP steel is the most widely used AHSS in the automotive industry. DP steel can be separated into different grades, such as DP 580, DP 780 and DP 980 depending on ultimate tensile strength. Therefore, the strength of DP steel has reached a limit (<1 GPa). In other words, the contribution of DP steel to the weight reduction of automobile has also reached its limit. The underlying reason for the limited strength of DP steel is ascribed to its soft ferrite matrix. In contrast, the hard martensite matrix in Q&P steel can overcome this deficiency. Therefore, Q&P steel is now a hot research topic in the field of AHSS. Currently, Q&P steel has two commercial steel grades, including the Q&P 980 and Q&P 1180. The development of Q&P steel makes the further weight reduction of automobiles possible.

Currently, researchers aim to further improve the strength of Q&P steel such as to the 1500 MPa level (Q&P 1500). The current commercial Q&P steel has a relatively low Manganese (Mn) content. For example, the Mn content in both Q&P 980 and Q&P 1180 is below 3 wt. %. It is well known that the Mn element is a strong austenite stabilizer. Owing to the low Mn content, the optimal quenching temperature for both Q&P 980 and Q&P 1180 is in the range of 200-300° C. The partitioning temperature is generally higher than the quenching temperature. Therefore, the Q&P concept initially encountered significant difficulties in existing steel production lines. Moreover, the strength of Q&P 980 and Q&P 1180 also approaches their limit. Therefore, to increase the strength of Q&P steel is a next step in the steel industry. The alloying design plays a key role in improving the properties of Q&P steel. Currently, researchers tend to increase the Mn element and Carbon (C) element in the Q&P steel. However, the Mn content in the proposed Q&P steel is mostly below 5 wt. %. As a result, the researchers are still not able to circumvent the high quenching temperature in the Q&P steel.

SUMMARY OF THE INVENTION

The present invention is directed to a novel and advantageous automotive steel including increased Mn content, and a simple method for fabricating the strong and ductile automotive steel.

In one aspect of the invention, a strong and ductile automotive steel is provided, which comprises manganese (Mn) in a range of 8-11 wt. %, carbon (C) in a range of 0.1-0.35 wt. %, aluminum (Al) in a range of 1-3 wt. %, vanadium (V) in a range of 0.05-0.5 wt. %, and a balance of iron (Fe), based on the weight of the automotive steel.

Preferably, the automotive steel comprises 9.5-10.5 wt. % Mn, 0.18-0.22 wt. % C, 1.8-2.2 wt. % Al, 0.08-0.12 wt. % V, and a balance of Fe.

In an exemplary embodiment, the strong and ductile automotive steel comprises, by weight percent: 10 wt. % Mn, 0.2 wt. % C, 2 wt. % Al, 0.1 wt. % V, and a balance of Fe.

Preferably, this automotive steel further comprises at least one of the following elements: nickel (Ni) in a range of 0.1-2.0 wt. %, chromium (Cr) in a range of 0.2-2.0 wt. %, molybdenum (Mo) in a range of 0.1-0.5 wt. %, silicon (Si) in a range of 0.3-2.0 wt. %, boron (B) in a range of 0.0005-0.005 wt. %, niobium (Nb) in a range of 0.02-0.10 wt. %, titanium (Ti) in a range of 0.05-0.25 wt. %, copper (Cu) in a range of 0.25-0.50 wt. %, and rhenium (Re) in a range of 0.002-0.005 wt. %.

In another aspect of the invention, a method of manufacturing an automotive steel is provided, which comprises: preparing an ingot including manganese (Mn) in a range of 8-11 wt. % and a balance of Fe; providing a steel sheet from the ingot; isothermally holding the steel sheet to form an austenite; cooling down the steel sheet to room temperature; tempering the steel sheet at a temperature of 300-400° C.; and quenching the steel sheet to room temperature.

Preferably, the step of providing a steel sheet is performed by at least one of a cast, a hot rolling, a forging and a cold rolling.

Preferably, the isothermally holding is performed at a temperature of Ac3−20° C. to Ac3+100° C., where Ac3 is a temperature at which a ferrite fully transforms into the austenite form.

Preferably, the step of isothermally holding is performed for 5-20 minutes.

Preferably, the room temperature is in a range of 10° C. to 40° C.

Preferably, the step of cooling down is performed by at least one of air, oil, and water.

Preferably, the step of cooling down is performed at a first cooling rate higher than 0.5° C./s.

Preferably, the step of tempering the steel sheet is performed for 5-10 minutes.

Preferably, the step of quenching the steel is performed at a second cooling rate higher than 0.5° C./s.

Preferably, the ingot further includes carbon (C) in a range of 0.1-0.35 wt. %, aluminum (Al) in a range of 1-3 wt. %, and vanadium (V) in a range of 0.05-0.5 wt. %.

More preferably, the automotive steel comprises 9.5-10.5 wt. % Mn, 0.18-0.22 wt. % C, 1.8-2.2 wt. % Al, 0.08-0.12 wt. % V, and a balance of Fe, based on the weight of the automotive steel.

Preferably, the ingot further includes at least one of nickel (Ni), chromium (Cr), molybdenum (Mo), silicon (Si), boron (B), niobium (Nb), titanium (Ti), copper (Cu), and rhenium (Re).

In a preferred embodiment, the method for making a strong and ductile automotive steel comprises the following steps:

(1) providing ingots that comprise 8-11 wt. % Mn, 0.1-0.35 wt. % C, 1-3 wt. % Al, 0.05-0.5 wt. % V and a balance of Fe;

(2) forging and rolling the ingots to provide steel sheets having a thickness of 4-6 mm, and cooling the steel sheets;

(3) batch annealing at a temperature between 500-750° C. for 5-10 hours;

(4) pickling to remove the oxide layer in the steel sheets;

(5) cold rolling the steel sheets to provide cold steel sheets with final thickness of 0.8-2 mm;

(6) treating the steel sheets by thermal processing to obtain dual phase microstructure with an austenite embedded in a martensite matrix and cooling down the steel sheets to room temperature with a cooling rate higher than 0.5° C./s, wherein the thermal processing route comprises isothermally holding the steel sheets at a temperature range between Ac3−20° C. and Ac3+100° C. for a duration of 5-20 mins to form partial or full austenite; and (7) tempering the steel sheets at a temperature range between 300−400° C. for a duration of 5-20 mins and quenching to room temperature with a cooling rate higher than 0.5° C./s.

Preferably, the volume fraction of martensite after quenching to room temperature is in a range between 70% and 90%. The volume fraction of martensite (f) can be determined by the following equation $f=1-\exp(-C1(Ms-T))$, where C1 is an empirical parameter, Ms is the martensite starting temperature, and T is a temperature below the Ms temperature. Here the T is the room temperature (10-40° C.). The Ms temperature can be determined by the following equation: $Ms=539-423C-30.4Mn-17.7Ni-12.1Cr-7.5Mo-7.5Si$ (° C.), wherein Elements in this equation are in mass percent.

Preferably, the steel sheets are cooled by air, oil, or water down to room temperature.

Preferably, the steel sheets are cooled by water down to room temperature.

According to the present invention, the quenching temperature is decreased down to room temperature by increasing the Mn content in proposed Q&P steel, while conventional low temperature tempering is adopted to facilitate the C partitioning. Consequently, a strong and ductile Q&P steel is obtained. It will be a big improvement in the automotive industry to fabricate a strong and ductile Q&P steel by simple room temperature quenching and the low temperature tempering processes.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
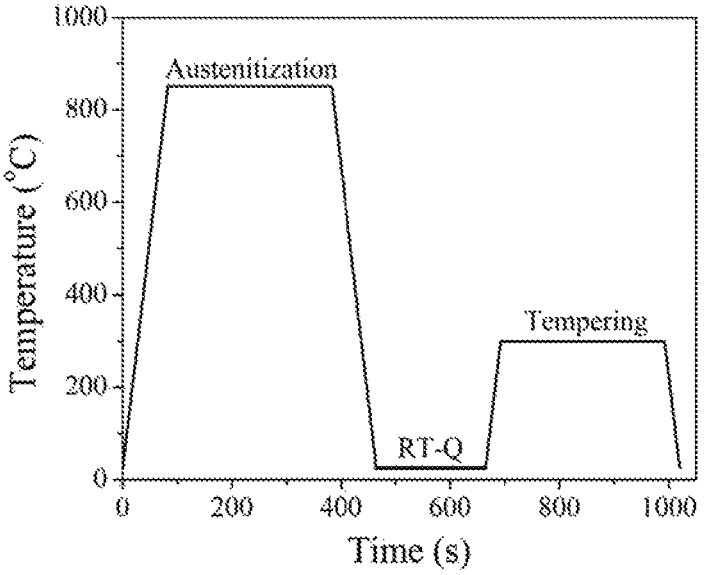
FIG. 1 is a schematic illustration for the thermomechanical processing routes of automotive steel with a chemical composition of Fe-10Mn-0.2C-2Al-0.1V (in wt. %) according to an embodiment of the present invention.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

According to the present invention, the strong and ductile automotive steel comprises, by weight percent: 8-11 wt. % Mn, 0.1-0.35 wt. % C, 1-3 wt. % Al, 0.05-0.5 wt. % V, and a balance of Fe.

In an exemplary embodiment, the strong and ductile automotive steel comprises, by weight percent: 10 wt. % Mn, 0.2 wt. % C, 2 wt. % Al, 0.1 wt. % V, and a balance of Fe.

According to the present invention, the C element is effective in increasing the strength of automotive steel. Simultaneously, C is a strong austenite stabilizer. In this invention, the C content is selected as above 0.1 wt. % to obtain these effects. However, the welding performance of automotive steel will decrease when the C content is higher than 0.35 wt. %. Therefore, the C content is selected at a range between 0.1 wt. % and 0.35 wt. %.

According to the present invention, the Mn element is also a strong austenite stabilizer. Similarly, the Mn element can provide the solid solution strengthening to improve the strength of automotive steel. To obtain the proper amount of martensite and austenite volume fraction after quenching to room temperature, the Mn content is selected as above 8 wt. % in the automotive steel. However, the Mn content should be not higher than 11 wt. % because the higher Mn content does not lead to a proper amount of martensite and consequently a desirable mechanical property. Therefore, the Mn content is selected at a range between 8 wt. % and 11 wt. %.

According to the present invention, the V element can increase the strength of automotive steel. Simultaneously, the V element can refine the austenite grain size and the resultant V precipitation can improve resistance to the delayed fracture of automotive steel. The amount of V is selected as above 0.05 wt. % to achieve the above effects. However, the addition of V will increase the price of the steel. Based on the above reason, the V content is selected as above 0.05 wt. % but is preferably below 0.5 wt. %.

According to the present invention, the Al element can inhibit the cementite precipitation during the tempering process. To achieve this effect, the Al content is selected as above 1 wt. %. However, if the Al content is higher than 3 wt. %, it is highly possible to have the large oxide inclusions and the delta-ferrite and result in poor ductility of automotive steel. Based on the above reason, the Al content is selected as above 1 wt. % but is below 3 wt. %.

In addition, the automotive steel can also include at least one of the following elements to improve the performance: Ni (0.1-2.0 wt %), Cr (0.2-2.0 wt %), Mo (0.1-0.5 wt %) and B (0.0005-0.005 wt %). These elements can be included to improve hardenability and the low temperature toughness of automotive steel. To achieve these effects, the amount of Ni and Mo should be higher than 0.1 wt %, the amount of Cr should be higher than 0.2 wt % and the amount of B should be higher than 0.0005 wt. %. However, when the Ni content or Cr content is higher than 2 wt %, or when the Mo content is higher than 0.5 wt % or when the B content is higher than 0.005 wt %, a saturation effect will take place and also the price of automotive steel will be increased. Therefore, the amount of these elements should be kept below the above upper limits.

According to the present invention, Nb (0.02-0.1 wt %) and Ti (0.05-0.25 wt %) may also be added to refine the prior austenite grain size. The Ti can form TiN and suppress the formation of BN so that the B atoms can increase the hardenability of automotive steel. Preferably, the amount of Nb is higher than 0.02 wt % while the amount of Ti is higher than 0.05 wt %. However, when the Nb content is higher than 0.1 wt % or when the Ti is higher than 0.25 wt %, a saturation effect will take place and also the price of automotive steel will be increased. Therefore, the amount of these elements should be kept below the above upper limits.

According to the present invention, the addition of Cu (0.25-0.50 wt %) is to improve the strength of automotive steel. To achieve this effect, the amount of Cu is selected as above 0.25 wt %. However, when the amount of Cu is higher than 0.5 wt %, the steel will have poor hot rolling performance and the welding ability will be decreased. Therefore, the amount of Cu should be kept below the above upper limit.

According to the present invention, the addition of Si (0.3-1.0 wt %) is to improve the oxidation resistance and the corrosion resistance of automotive steel. The Si element can also inhibit the precipitation of the cementite during tempering process. To achieve this effect, the amount of Si is selected as above 0.3 wt %. However, when the amount of Si is higher than 1.0 wt %, the steel will have a strong oxide layer, which will be embedded into the surface during hot rolling process. Consequently, the surface quality, hot ductility, welding ability, and the fatigue property will be reduced. Therefore, the amount of Si should be kept below the above upper limit.

According to the present invention, the addition of Re (0.25-0.50 wt %) is to improve the morphology and size distribution of particles in automotive steel. To achieve this effect, the amount of Re is selected as above 0.002 wt %. However, when the amount of Re is higher than 0.005 wt %, a saturation effect will take place and also the price of automotive steel will be increased. Therefore, the amount of Re should be kept below the above upper limit.

According to the present invention, the ingots can be either cast, hot rolled or cold rolled to produce the automotive steel. For casting technology, it is preferable to use continuous casting to produce slab. For hot rolling, it is preferable to heat the slab at temperatures between 1100-1250° C. and hot rolled to thickness of 50-80 mm by 5-20 passes to produce a thick hot rolled sheet or to have thin hot rolled plate by further hot rolling down to thickness of 4-10 mm by 7-10 passes. For cold rolling, it is preferable to employ a batch annealing at temperatures between 500-750° C. for 5 to 10 hours to soften the hot rolled sheets. Cold rolling to provide cold rolled sheets with final thickness between 0.8 mm and 2 mm by 5-12 passes. If the hot rolled sheets can be directly cold rolled down to the targeted thickness (0.8 mm to 2 mm) after pickling, then the prior batch annealing step can be removed to save energy and cost. The other conventional thermal mechanical processing technologies in the steel industry, such as forging and Zn coating, can also be used here to produce the automotive steel.

After obtaining the steel sheets, the thermal processing route is employed to obtain dual phase microstructure with austenite embedded in the martensite matrix. The steel sheet is isothermally held at temperature range between Ac3−20° C. and Ac3+100° C. for a duration between 5 and 20 mins to form partial or full austenite. Ac3 refers to a temperature at which the ferrite fully transforms into austenite. This process can be adopted after the cooling of the hot rolled product down to room temperature or directly after the hot rolling process. Then the sheet is cooled down to room temperature with a cooling rate higher than 0.5° C./s. The cooling media can be water, oil, air, or other conventional cooling media in the steel industry. According to the chemical composition in present invention, there is a large amount of martensite with some retained austenite and/or minor ferrite after the quenching to room temperature.

Then the steel sheet is tempered at temperature range between 300 and 400° C. for a duration of 5-10 mins and finally quenched to room temperature with a cooling rate higher than 0.5° C./s. The cooling media can be water, oil, air, or other conventional cooling media in the steel industry. The tempering process is used to allow the C partitioning from the martensite to the retained austenite so that the austenite can have a proper mechanical stability and to provide the continuous transformation induced plasticity (TRIP) effect to improve the ductility of automotive steel. In addition, the tempering process is beneficial to alleviate the residual stress induced by martensitic transformation during quenching to room temperature. The Zn coating using either dip galvanized (GI) or hot-dip galvannealed (GA) can be employed to produce either galvanized or galvannealed steel sheets for automotive applications. In addition, the steel sheets without Zn coating can also be useful for automotive applications, depending on the requirement of automotive industries. It is worth to mention that the chemical composition should be designed to have a volume fraction of martensite of 70%-90% after quenching to room temperature. If the volume fraction of martensite is below 60%, then the amount of Mn content shall be decreased. It is undesirable to decrease the C content to obtain more volume fraction of martensite because decreasing the C content will significantly decrease the strength of martensite matrix. If the volume fraction of martensite is higher than 90%, then the Mn content and/or C content should be increased. Based on the previous reason on the strength of martensite, it is preferable to increase the C content to obtain less martensite matrix. The volume fraction of martensite (f) in the automotive steel with different Mn and C contents after quenching to room temperature can be determined by the following equation $f=1-\exp(-C1(Ms-T))$, where C1 is an empirical parameter obtained from a large amount of statistical data and can be chosen as −0.011, Ms is the martensite starting temperature, T is a temperature below the Ms temperature and here T is room temperature (10-40° C.). The Ms temperature can be determined by the following equation: $Ms=539-423C-30.4Mn-17.7Ni-12.1Cr-7.5Mo-7.5Si$ (° C.), where the elements are in the mass percent.

BEST MODES FOR CARRYING OUT THE INVENTION

Following are examples which illustrate procedures for practicing the invention. These examples should not be construed as limiting.

Example 1

This example is used to illustrate the production process of automobile steel having a composition of Fe-10Mn-0.2C-2Al-0.1V (wt. %).

(1) providing ingots, forging the ingots to steel sheets with a thickness of 12 mm, and cooling the steel sheets;
(2) pickling to remove the oxide layer in the steel sheets;
(3) isothermal holding the steel sheets at temperatures of 800° C., 850° C. or 900° C. for 10 mins; and cooling down the steel sheets to room temperature by immersing in water;
(4) tempering the steel sheets at temperatures of 300° C., 350° C. or 400° C. for 10 mins and quenching to room temperature by immersing in water.

FIG. 1 is a schematic illustration of the thermal processing route to obtain the tensile test samples of automotive steel. The processing route includes the annealing to obtain partial or full austenite, followed by room temperature quenching (RT-Q) to obtain martensite and finally the low temperature tempering to allow the C partitioning. The ASTM sub-standard tensile test samples with thickness of 4 mm are wire cut from the forged large steel plate which has a thickness of 12 mm.

Comparative Example 1

This comparative example is used to illustrate the production process of automobile steel of the prior art having a composition of Fe-0.2C-1.5Mn-1.5Si (wt. %).

(1) providing ingots, forging and hot rolling the ingots to steel sheets with a thickness of 4 mm, and cooling the steel sheets;
(2) batch annealing at a temperature between 600° C. for 1 hour;
(3) pickling to remove the oxide layer in the steel sheets;
(4) cold rolling the steel sheets to provide cold steel sheets with final thickness of 1.5 mm;
(5) isothermal holding the steel sheets at 860° C. for 5 minutes and then cooled slowly at 5° C./s to ~725° C.; then the steel was rapidly quenched to 280° C. at 50° C./s and then re-heated and held at 350° C. for 10 s and quenched to room temperature at 50° C./s.

As compared to the comparative example 1, the present invention substantially simplifies the processing route. For instance, the comparative example 1 shall precisely control the temperature to achieve desirable microstructures of ferrite, martensite and austenite. In contrast, the present invention just involves the room temperature quenching to have martensite and austenite. Moreover, as discussed below, the present invention provides steels with much better mechanical properties than that of comparative example 1.

A greater understanding of the present invention and it many advantages may be had from the following examples, given by way illustration. The following examples show some of the methods, applications, embodiments, and variants of the present invention. They are, of course, not to be considered as limiting the invention. Numerous changes and modifications can be made with respect to the invention.

Figure 2:
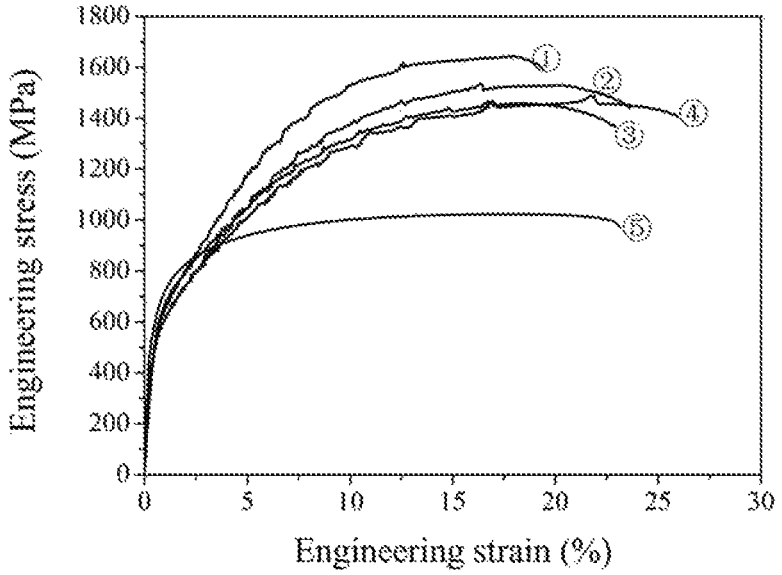
FIG. 2 shows the engineering stress strain curves of the automotive steel according to an exemplary embodiment when isothermally held at 800° C. for 10 mins in the air furnace.

FIG. 2 shows the engineering stress strain curves of Fe-10Mn-0.2C-2Al-0.1V (wt. %). The tensile samples are isothermally held at 800° C. for 10 mins in the air furnace, followed by water quenching down to room temperature. Then the tensile samples are tempered at 300° C. for 10 mins, or 350° C. for 10 mins, or 400° C. for 5 mins, or 400° C. for 10 mins. The tensile samples are then quenched in water after the tempering. The tensile tests are performed at room temperature on tensile samples with gauge length of 32 mm. The grid speed is 1.2 mm/min during the tensile test. The curve ① corresponds to the tensile test sample that is tempered at 300° C. for 10 mins. The curve ② corresponds to the tensile test sample that is tempered at 350° C. for 10 mins. The curve ③ corresponds to the tensile test sample that is tempered at 400° C. for 5 mins. The curve ④ corresponds to the tensile test sample that is tempered at 400° C. for 10 mins. The curve ⑤ corresponds to the tensile test sample obtained from comparative example 1.

Figure 3:
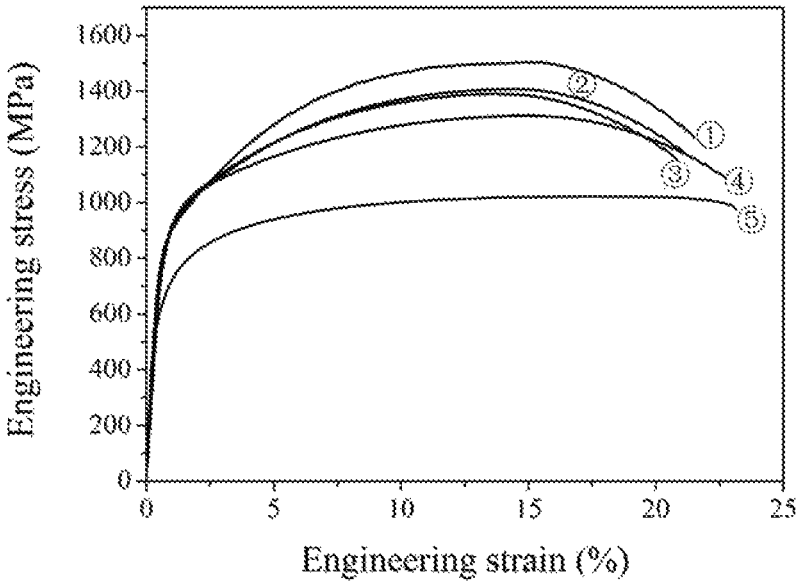
FIG. 3 shows the engineering stress curves of the automotive steel according to an embodiment of the subject invention when isothermally held at 850° C. for 10 mins in the air furnace.

FIG. 3 shows the engineering stress strain curves of Fe-10Mn-0.2C-2Al-0.1V (wt. %). The tensile samples are isothermally held at 850° C. for 10 mins in the air furnace, followed by water quenching down to room temperature. Then the tensile samples are tempered at 300° C. for 10 mins, or 350° C. for 10 mins, or 400° C. for 5 mins, or 400° C. for 10 mins. The tensile samples are then quenched in water after the tempering. The tensile tests are performed at room temperature on tensile samples with gauge length of 32 mm. The grid speed is 1.2 mm/min during the tensile test. The curve ① corresponds to the tensile test sample that is tempered at 300° C. for 10 mins. The curve ② corresponds to the tensile test sample that is tempered at 350° C. for 10 mins. The curve ③ corresponds to the tensile test sample that is tempered at 400° C. for 5 mins. The curve ④ corresponds to the tensile test sample that is tempered at 400° C. for 10 mins. The curve ⑤ corresponds to the tensile test sample obtained from comparative example 1.

Figure 4:
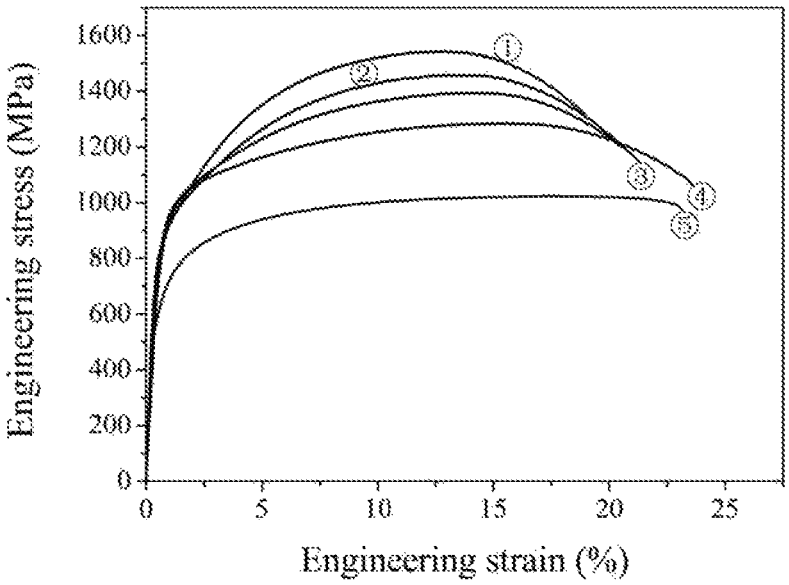
FIG. 4 shows the engineering stress curves of the automotive steel according to an embodiment of the subject invention when isothermally held at 900° C. for 10 mins in the air furnace.

FIG. 4 shows the engineering stress strain curves of Fe-10Mn-0.2C-2Al-0.1V (wt. %). The tensile samples are isothermally held at 900° C. for 10 mins in the air furnace, followed by water quenching down to room temperature. Then the tensile samples are tempered at 300° C. for 10 mins, or 350° C. for 10 mins, or 400° C. for 5 mins, or 400° C. for 10 mins. The tensile samples are then quenched in water after the tempering. The tensile tests are performed at room temperature on tensile samples with gauge length of 32 mm. The grid speed is 1.2 mm/min during the tensile test. The curve ① corresponds to the tensile test sample that is tempered at 300° C. for 10 mins. The curve ② corresponds to the tensile test sample that is tempered at 350° C. for 10 mins. The curve ③ corresponds to the tensile test sample that is tempered at 400° C. for 5 mins. The curve ④ corresponds to the tensile test sample that is tempered at 400° C. for 10 mins. The curve ⑤ corresponds to the tensile test sample obtained from comparative example 1.

In embodiments of the present invention, the partial or full austenitization at temperatures between 800° C. and 900° C. and the low temperature tempering at temperatures between 300° C. and 400° C. can achieve excellent mechanical properties of automotive steel. It indicates the processing window for the present automotive steel is wide and is therefore easy for the industrial production. In particular, the full austenitization at 850° C. for 10 mins and tempering at 300° C. for 10 mins can obtain excellent tensile properties. This austenitization temperature can be directly realized in the existing steel industry, suggesting that the automotive steel in this patent can go for mass production with reduced barrier. The yield strength of automotive steel is in the range of 600-950 MPa with preferable range of 800-950 MPa. The tensile strength of automotive steel is in the range of 1280-1670 MPa with preferable range of 1500-1670 MPa. The elongation of automotive steel is in the range of 19-26% with preferable range of 21-23%. Preferably, the austenitization at 850° C. for 10 mins and tempering at 300° C. for 10 mins can achieve yield strength of 910 MPa, tensile strength of 1505 MPa and total elongation of 21.5%. More importantly, the automotive steel of the subject invention has high strength, no yield point elongation, no strain aging and high strain hardening rate. These features are desirable for application in automotive industry. The tensile strength of present automotive steel is higher than the existing commercial automotive steels, such as the DP780, Q&P980 and Q&P1180. Moreover, the automotive steel also has a good ductility (~20%) and a large post-uniform elongation (~7%). The post-uniform elongation affects the hole-expansion performance, which is a very important evaluation guideline in the automotive industry. For a person skilled in the art of this filed, the large post-uniform elongation also suggests that the present automotive steel has a good fracture toughness, which is very important for the safety of automotive steel during service.

Besides the chemical composition of Fe-10Mn-0.2C-2Al-0.1V (wt. %), the embodiments of the subject invention further comprise other compositions for mechanical testing. The main guideline for the selection of chemical composition is to have a volume fraction of martensite in the range of 70%-90% at room temperature so that the martensite can partition C into the retained austenite to achieve tailored mechanical stability. The details of the chemical compositions can be found in Table 1.

TABLE 1

| sample | C wt % | Mn wt % | V wt % | Al wt % | P wt % | S wt % | Ni wt % | Cr wt % | Mo wt % | Si wt % | B wt % | Nb wt % | Ri wt % | Re wt % |
|---|---|---|---|---|---|---|---|---|---|---|---|---|---|---|
| G1 | 0.1 | 11 | 0.1 | 2 | 0.02 | 0.02 | — | — | — | — | — | — | — | — |
| G2 | 0.15 | 10.5 | 0.15 | 1 | 0.01 | 0.01 | — | — | — | — | — | — | — | — |
| G3 | 0.2 | 10 | 0.1 | 0.5 | 0.001 | 0.008 | 0.1 | — | 0.2 | 0.3 | — | 0.05 | — | 0.002 |
| G4 | 0.25 | 9.5 | 0.25 | 1.5 | 0.003 | 0.02 | 0.5 | 0.2 | 0.4 | 0.5 | — | 0.1 | 0.2 | 0.004 |
| G5 | 0.3 | 8.5 | 0.25 | 2.5 | 0.005 | 0.02 | 1 | 0.5 | — | 0.2 | — | 0.09 | 0.1 | — |
| G6 | 0.35 | 8 | 0.5 | 1.8 | 0.02 | 0.005 | — | 1 | 0.1 | — | 0.001 | — | 0.08 | — |
| G7 | 0.15 | 11 | 0.3 | 2 | 0.003 | 0.001 | — | 0.8 | — | — | 0.0009 | 0.03 | — | 0.003 |
| G8 | 0.2 | 10.5 | 0.2 | 2.5 | 0.008 | 0.003 | 0.5 | — | 0.3 | 0.25 | — | 0.04 | — | 0.005 |
| G9 | 0.22 | 10 | 0.1 | 3 | 0.006 | 0.003 | 0.8 | 1 | 0.4 | — | — | — | 0.07 | — |
| G10 | 0.33 | 8.5 | 0.45 | 2.8 | 0.02 | 0.02 | 1 | 0.2 | 0.1 | 0.3 | 0.0005 | 0.02 | 0.05 | 0.002 |
| G11 | 0.25 | 10 | 0.2 | 1 | 0.02 | 0.02 | 0.1 | 1 | 0.5 | 1 | 0.005 | 0.1 | 0.25 | 0.005 |

Samples G1-G11 correspond to the different chemical compositions. The experiments indicate that the automotive steel with these chemical compositions fabricated by the proposed method in this invention can all achieve excellent mechanical properties and are better than the conventional automotive steels.

The embodiments of the present invention obtain a dual phase microstructure of martensite and austenite at room temperature by simple room temperature quenching based on the proper design of chemical compositions. The C partitioning takes place during the low temperature tempering process. The stability of the retained austenite grains relies on the C content. The austenite grains with the different mechanical stability can provide continuous TRIP effect to improve the ductility. The phase fraction after quenching to room temperature from full austenite regime depends on the kinds and amounts of alloying elements. In the embodiments, the strong and ductile automotive steel is achieved by tuning the phase fraction of martensite and austenite through using the austenite stabilizers. The method used to produce the automotive steel in the embodiments circumvents the difficulties of high quenching temperature of conventional Q&P steels. In addition, by controlling the prior austenite grain size such as through microalloying or different austenitization temperature and time can also modify the phase fraction of martensite and austenite at room temperature. Therefore, it can also be used to optimize the mechanical properties of present automotive steel.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A strong and ductile automotive steel comprising manganese in a range of 10.1-11 wt. %, carbon in a range of 0.25-0.35 wt. %, aluminum in a range of 1-3 wt. %, vanadium in a range of 0.25-0.5 wt. %, and a balance of iron, based on the weight of the automotive steel; wherein the automotive steel has a yield strength in a range of 600-825 MPa, a tensile strength in a range of 1651-1670 MPa, and an elongation in a range of 22.3-26%.

2. An automotive steel comprising manganese in a range of 10.1-11 wt. %, carbon in a range of 0.25-0.35 wt. %, aluminum in a range of 1-3 wt. %, vanadium in a range of 0.05-0.5 wt. %, and a balance of iron, based on weight of the automotive steel; and wherein the automotive steel exhibits a tensile strength in a range of 1655-1670 MPa, a yield strength in a range of 800-825 MPa, and an elongation in a range of 22.3-23%.

3. An automotive steel comprising manganese in a range of 10.1-11 wt. %, carbon in a range of 0.25-0.35 wt. %, aluminum in a range of 1-3 wt. %, vanadium in a range of 0.21-0.39 wt. %, and a balance of iron, based on weight of the automotive steel; and wherein the automotive steel exhibits a tensile strength in a range of 1655-1670 MPa, a yield strength in a range of 800-825 MPa, and an elongation in a range of 22.3-23%.

4. The automotive steel of claim 1, wherein the automotive steel comprises 10.1-10.5 wt. % Mn, 0.25-0.31 wt. % C, 1.8-2.2 wt. % Al, 0.3-0.5 wt. % V, and a balance of Fe.

5. The automotive steel of claim 1, wherein the automotive steel comprises 10.1 wt. % Mn, 0.31 wt. % C, 2 wt. % Al, 0.45 wt. % V, and a balance of Fe.

6. The automotive steel of claim 1, wherein the automotive steel further comprises at least one of the following elements: nickel in a range of 0.1-2.0 wt. %, chromium in a range of 0.2-2.0 wt. %, molybdenum in a range of 0.1-0.5 wt. %, silicon in a range of 0.3-2.0 wt. %, boron in a range of 0.0005-0.005 wt. %, niobium in a range of 0.02-0.10 wt. %, titanium in a range of 0.05-0.25 wt. %, copper in a range of 0.25-0.50 wt. %, and rhenium in a range of 0.002-0.005 wt. %.

7. The automotive steel of claim 2, wherein the automotive steel comprises 10.1-10.5 wt. % Mn, 0.31-0.35 wt. % C, 1.8-2.2 wt. % Al, 0.08-0.12 wt. % V, and a balance of Fe.

8. The automotive steel of claim 2, wherein the automotive steel comprises 10.1 wt. % Mn, 0.31 wt. % C, 2 wt. % Al, 0.1 wt. % V, and a balance of Fe.

9. The automotive steel of claim 2, wherein the automotive steel further comprises rhenium in a range of 0.002-0.005 wt. %.

10. The automotive steel of claim 1, wherein the automotive steel further comprises rhenium in a range of 0.002-0.005 wt. %.

11. The automotive steel of claim 3, wherein the automotive steel further comprises rhenium in a range of 0.002-0.005 wt. %.

* * * * *